US010008809B2

(12) United States Patent
Maesoba et al.

(10) Patent No.: US 10,008,809 B2
(45) Date of Patent: Jun. 26, 2018

(54) SHIELD CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hiroyoshi Maesoba, Mie (JP); Toshifumi Ichio, Mie (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP)

( * ) Notice: Subject to any disclaimer, the term of this patent is extended or adjusted under 35 U.S.C. 154(b) by 0 days. days.

(21) Appl. No.: 15/546,028

(22) PCT Filed: Jan. 19, 2016

(86) PCT No.: PCT/JP2016/051355
§ 371 (c)(1),
(2) Date: Jul. 25, 2017

(87) PCT Pub. No.: WO2016/121565
PCT Pub. Date: Aug. 4, 2016

(65) Prior Publication Data

US 2018/0013239 A1 Jan. 11, 2018

(30) Foreign Application Priority Data

Jan. 29, 2015 (JP) ..... 2015-015441

(51) Int. Cl.
*H01R 13/648* (2006.01)
*H01R 24/60* (2011.01)
*H01R 13/6593* (2011.01)

(52) U.S. Cl.
CPC ..... *H01R 13/648* (2013.01); *H01R 24/60* (2013.01); *H01R 13/6593* (2013.01)

(58) Field of Classification Search
CPC ..... H01R 13/6593
See application file for complete search history.

(56) References Cited

U.S. PATENT DOCUMENTS 5,199,903 A 4/1993 Asick et al.
5,273,459 A * 12/1993 Davis ..... H01R 13/6593 439/607.48

(Continued)

FOREIGN PATENT DOCUMENTS

| | | |
|---|---|---|
| JP | 5-94849 | 4/1993 |
| JP | 2009-110880 | 5/2009 |
| JP | 2013-125585 | 6/2013 |

OTHER PUBLICATIONS

International Search Report dated Mar. 29, 2016.

*Primary Examiner* — Tho D Ta
(74) *Attorney, Agent, or Firm* — Gerald E. Hespos; Michael J. Porco; Matthew T. Hespos

(57) ABSTRACT

A shield connector includes wires (12, 14, 15), terminals (20) connected respectively to the wires, a housing (30) for arranging upper and lower rows of terminals, and a shield shell (40) for covering the housing. Each terminal (20) includes a terminal connecting portion (21) to be connected to a mating terminal and a wire connecting portion (23) to be soldered to the corresponding wires. The housing (30) includes a housing body for accommodating the terminal connecting portions and an extending plate (35) extending rearward along a connecting direction to a mating housing from the housing body and arranged between the wire connecting portions of the first and second terminal rows. The shield shell (40) includes first and second open portions (58, 59) for exposing each of one and other surfaces of the (Continued)

housing extending portion, and first and second covers (60A, 60B) for covering the first and second open portions.

7 Claims, 25 Drawing Sheets

(56) References Cited

U.S. PATENT DOCUMENTS

| | | | | |
|---|---|---|---|---|
| 6,932,640 | B1 * | 8/2005 | Sung | H01R 4/2433 439/405 |
| 8,500,494 | B2 * | 8/2013 | Wu | H01R 13/6461 439/660 |
| 9,093,806 | B1 * | 7/2015 | Yang | H01R 24/60 |
| 9,276,330 | B2 * | 3/2016 | Wu | H01R 12/775 |

* cited by examiner

SHIELD CONNECTOR

BACKGROUND

1. Field of the Invention

This specification relates to a shield connector.

2. Description of the Related Art

Japanese Unexamined Patent Publication No. 2013-125585 discloses a shield connector for communication mounted in a vehicle, such as an electric or hybrid vehicle, and arranged in a wired communication path between an in-vehicle electrical component (car navigation system, ETC, monitor or the like) and an external device (camera or the like) or between in-vehicle electrical components in a vehicle. Such a shield connector includes a housing with cavities. Connection terminals, for connecting mating terminals, and signal wires are accommodated in the cavities. The housing and connected parts of the connection terminals and the wires are shielded collectively shielded by a shield unit.

In such a shield connector, connection terminals (e.g. ten) are arranged in rows, and an operation of connecting the individual connection terminals and wires accommodated in the housing tends to be cumbersome. To make the connecting operation of the connection terminals and the wires relatively easily, it is preferable to employ a soldering technique instead of the conventional crimp connecting method. However, when the connection terminals are arranged in a plurality of rows, conductive paths may be short-circuited between the respective rows. To prevent such a short circuit, it is thought to provide a housing for each row and to join the housings after the connection terminals and the wires are soldered and connected. However, a structure may become complicated and enlarged. Further, it is not possible to stack the housings or accommodate the housings into a shield shell until the solder connection is completed, thereby causing a problem that a work sequence is restricted.

The technique disclosed in this specification was completed based on the above situation and aims to provide a shield connector having a simple configuration and that is assembled easily.

SUMMARY

A shield connector disclosed in this specification includes wires and terminals to be connected respectively to the wires. The connector further has a housing for arranging and holding a first terminal row and a second terminal row in two stages in a vertical direction. The first and second terminal rows are formed by laterally arranging the terminals in the respective row. The connector further has a shield shell for covering the housing. Each of the terminals includes a terminal connecting portion to be connected to a mating terminal and a wire connecting portion to be soldered to the corresponding wire. The housing includes a housing body for accommodating the terminal connecting portions and a housing extending plate that extends rearward along a connecting direction to a mating housing from the housing body and to be arranged between the wire connecting portions of the first terminal row and the wire connecting portions of the second terminal row. The shield shell includes a first opening and a second opening for exposing each of opposite surfaces of the housing extending plate, a first cover for covering the first opening and a second cover for covering the second opening portion.

According to the above configuration, the terminals and the wires can be soldered easily in the housing extending portion exposed through the first and second openings of the shield shell by removing the first and second covers. Thus, before the terminals and the wires are connected, it is possible to accommodate the terminals into the housing and the housing into the shield shell in advance. Therefore, although the configuration is simple, a degree of freedom of a work sequence is enhanced. In addition, the first and second terminal rows are partitioned completely by the housing extending portion. Therefore, the wire connecting portions of the first terminal row and those of the second terminal row are not short-circuited by soldering.

The first and second covers may have the same shape and size. According to this configuration, manufacturing cost can be suppressed as compared to the case where the first and second covers are shaped and/or sized differently.

In the case of shielding a plurality of wires, it is conventionally known to collectively enclose the wires by a shield layer and an insulation coating covering an outer periphery of the shield layer, expose an end part of the shield layer at an end part of the insulation coating and conductively connect the end part of this shield layer by fastening this end part by a pair of barrel pieces provided on a shield shell. However, when the shield shell is provided with the first and second open portions as described above, the strength of parts of the barrel pieces provided near the first and second openings and coupled to the shield shell may be reduced.

Accordingly, the shield shell may be provided with a pressing piece extending along the end part of the shield layer and to be fastened together with the end part of the shield layer by the barrel pieces in addition to the barrel pieces for fastening the end part of the shield layer. According to this configuration, the wires collectively enclosed are coupled to the shield shell not only by the barrel pieces, but also by the pressing piece fastened together with the wires. Thus, the shield shell and the end part of the shield layer can be connected reliably and the collectively enclosed wires can be held reliably in the shield shell by the barrel pieces and the pressing piece.

According to this specification, a shield connector is obtained that has a simple configuration and is assembled easily.

DETAILED DESCRIPTION

One embodiment is described with reference to FIGS. 1 to 27. A shield connector 10 is mounted in a vehicle such as an electric or hybrid vehicle and is arranged, for example, in a wired communication path between an in-vehicle electrical component (car navigation system, ETC, monitor or the like) and an external device (camera or the like) or between in-vehicle electrical components in a vehicle. In the following description, an upper side and a lower side of FIG. 1 are referred to as an upper side and a lower side concerning a vertical direction, a left-lower side and a right-upper side of FIG. 1 are referred to as a left side and a right side concerning a lateral direction, and a left side and a right side of FIG. 2 are referred to as a front side and a rear side concerning a front-rear direction.

Figure 1:
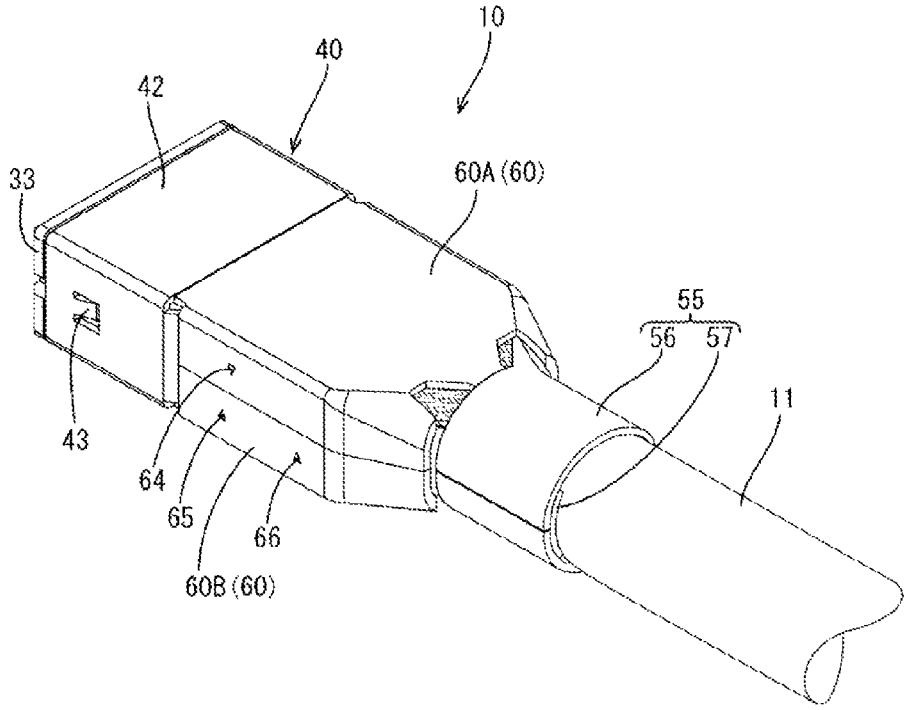
FIG. 1 is a perspective view of a shield connector of one embodiment connected to an end part of a shielded cable.
Figure 2:
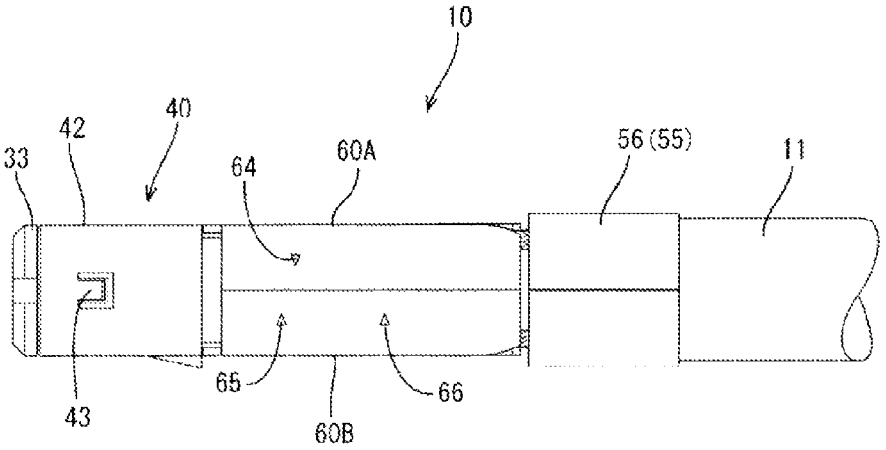
FIG. 2 is a side view showing the shield connector connected to the end part of the shielded cable.

The shield connector 10 of this embodiment includes a shielded cable 11 having a plural (ten in this embodiment) wires 12, 13, 14 and 15, a plural (ten in this embodiment) terminals 20 to be connected to end parts of the respective wires 12 to 15, a housing 30 for accommodating the terminals 20, and a shield shell 40 for covering the housing 30 and the wires 12 to 15 (see FIGS. 1 and 2).

(Shielded Cable 11)

Figure 3:
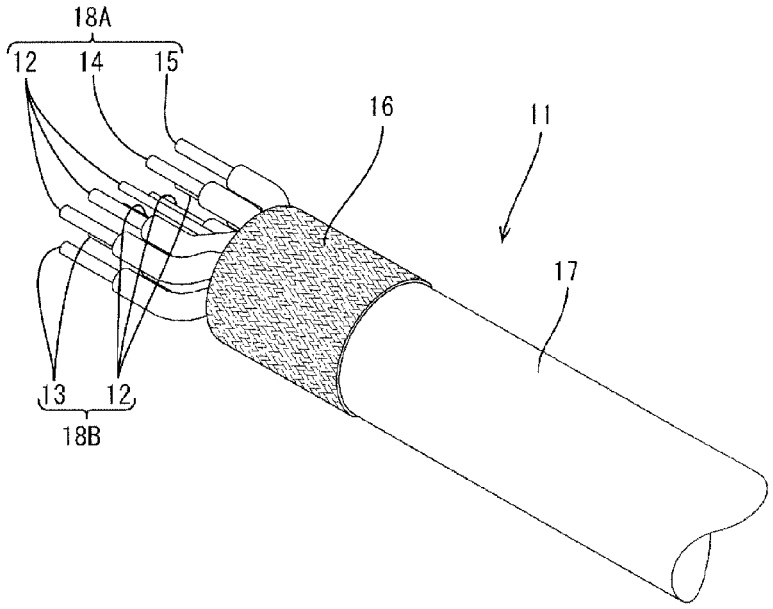
FIG. 3 is a perspective view of the shielded cable.
Figure 4:
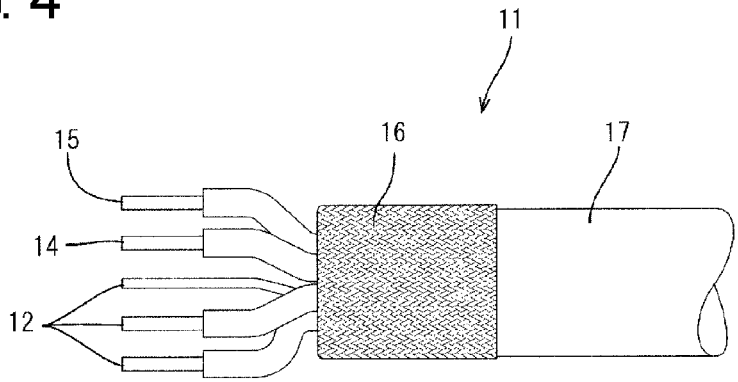
FIG. 4 is a plan view of the shielded cable.
Figure 5:
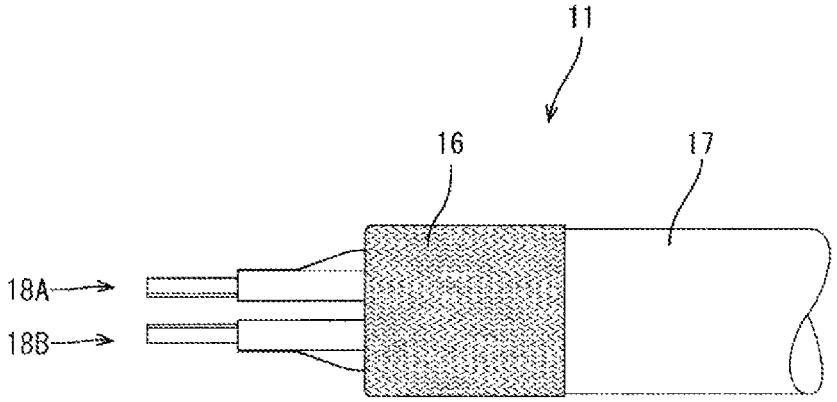
FIG. 5 is a side view of the shielded cable.

The shielded cable 11 is a cable capable of high speed communication of 1 GHz or faster and includes, as shown in FIGS. 3 to 5, the ten wires 12 to 15. A shield layer 16 collectively encloses the wires 12 to 15 and is formed of a braided wire configured by braiding thin metal wires. An insulation coating 17 covers the outer periphery of the shield layer 16 and is made of insulating synthetic resin.

(Wires 12 to 15)

Out of the ten wires 12 to 15, the wires 12 are two sets of high-speed cables (differential pair cables with a shield and a drain wire) as first communication wires and are wires of USB (Universal Serial Bus) 3.0 standard in this embodiment. The wires 13 are one pair (twisted pair cable without a shield) for second communication having a lower maximum data transfer speed than the first communication wires and are wires of USB 2.0 standard in this embodiment. The wire 14 is one power supply wire to be connected to a power supply and the wire 15 is one ground wire connected to ground.

Each wire 12 to 15 is such that a conductor made of a metal wire is coated with an insulation layer made of insulating synthetic resin. End parts of the ten wires 12 to 15 extending forward from the ends of the shield layer 16 and the insulation coating 17 of the shielded cable 11 have the insulation layers removed, whereby the conductors to be connected to the terminals 20 are exposed. The wires 12 to 15 are divided into upper and lower groups on a leading end side with each group having five wires. The wires in each group are arranged laterally in a row in each of upper and lower stages, thereby configuring upper and lower wire rows 18A, 18B.

(Terminals 20)

Figure 10:
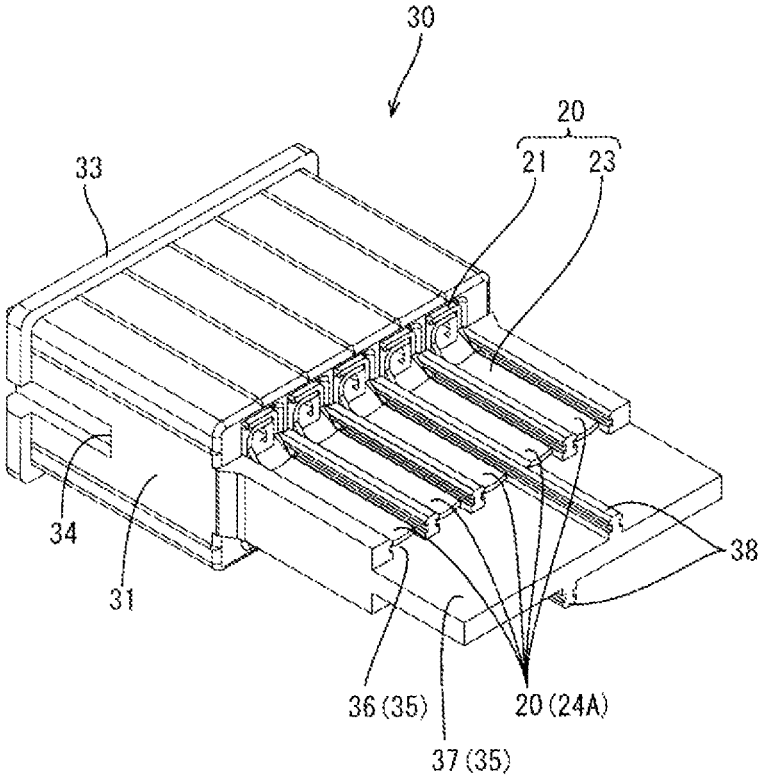
FIG. 10 is a perspective view of the connector housing accommodating terminals.

A front side of the terminal 20 defines a terminal connecting portion 21 in the form of a rectangular tube, and a wire connecting portion 23 to be connected to the conductor of the wire 12 to 15 is formed integrally on a rear side of the terminal connecting portion 21 (see FIG. 10). The terminal connecting portion 21 is provided with a resilient contact piece 25 (see FIG. 21) to be connected to a mating male terminal. The wire connecting portion 23 is in the form of a long and narrow plate extending rearward and slightly curved so that a widthwise central part is lower (see FIG. 22). The conductor of the wire 12 to 15 is placed on an upper surface side of the wire connecting portion 23 and soldered so that the terminal 20 and the wire 12 to 15 are connected electrically.

(Housing 30)

The housing 30 is made of insulating synthetic resin and includes, as shown in FIGS. 6 to 10, a housing body 31 for accommodating the terminal connecting portions 21 of the respective terminals 20 and a housing extending plate 35 extending rearward from the housing body 31.

The housing body 31 is formed into a rectangular parallelepiped shape and five cavities 32 for accommodating the terminals 20 are laterally arranged at intervals in each of upper and lower stages. A flange 33 protrudes out on the front end of the housing body 31. Further, left and right outer side surfaces of the housing body 31 are cut from the front end edges toward a rear side to form locking grooves 34 configured to lock locking pieces 43 of the shield shell 40 to be described later.

Each cavity 32 has a rectangular cross-section corresponding to the outer peripheral shape of the terminal connecting portion 21 and extends in the front-rear direction according to a length of the terminal connecting portion 21. A front stop wall 39 (see FIGS. 8 and 9) for restricting a forward movement of the terminal 20 is formed on a front part of the cavity 32. A deflectable and deformable withdrawal restricting piece (not shown) for restricting the rearward withdrawal of the terminal 20 by locking the terminal connecting portion 21 is cantilevered forward at an inner wall of the cavity 32.

Figure 6:
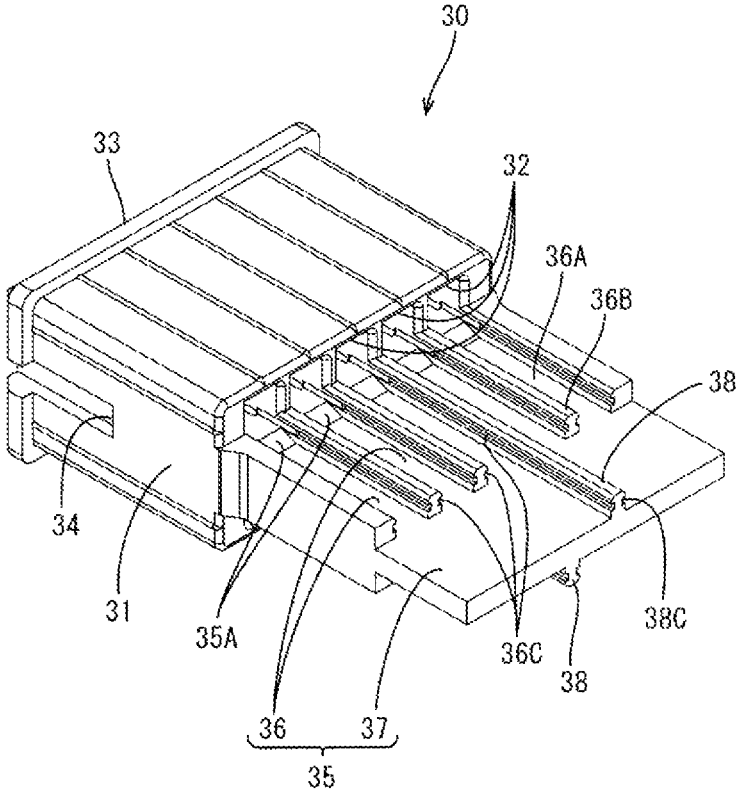
FIG. 6 is a perspective view of a connector housing.
Figure 7:
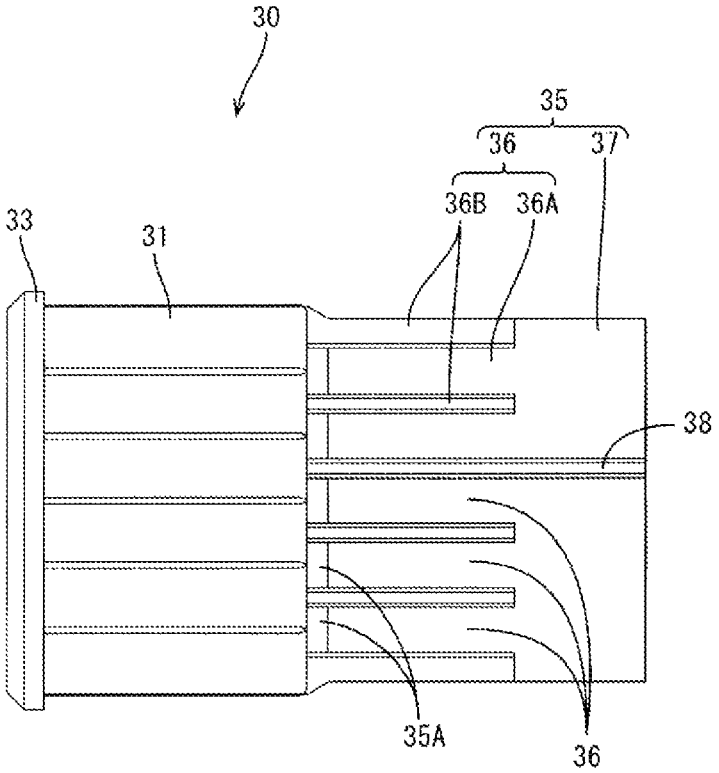
FIG. 7 is a plan view of the connector housing.
Figure 8:
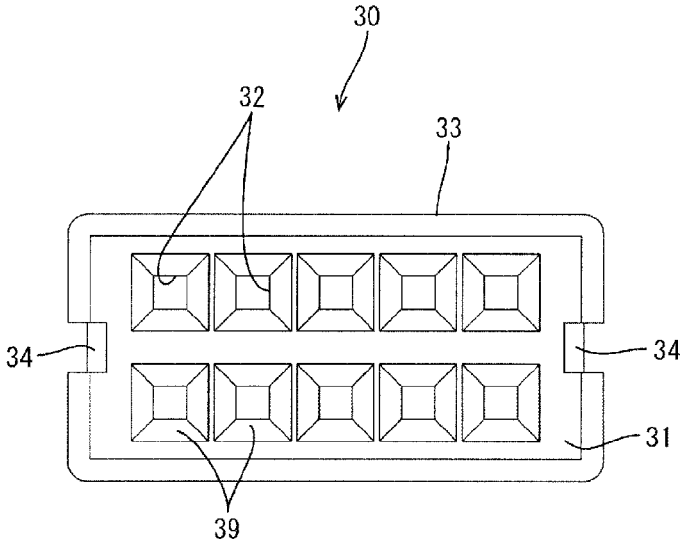
FIG. 8 is a front view of the connector housing.
Figure 9:
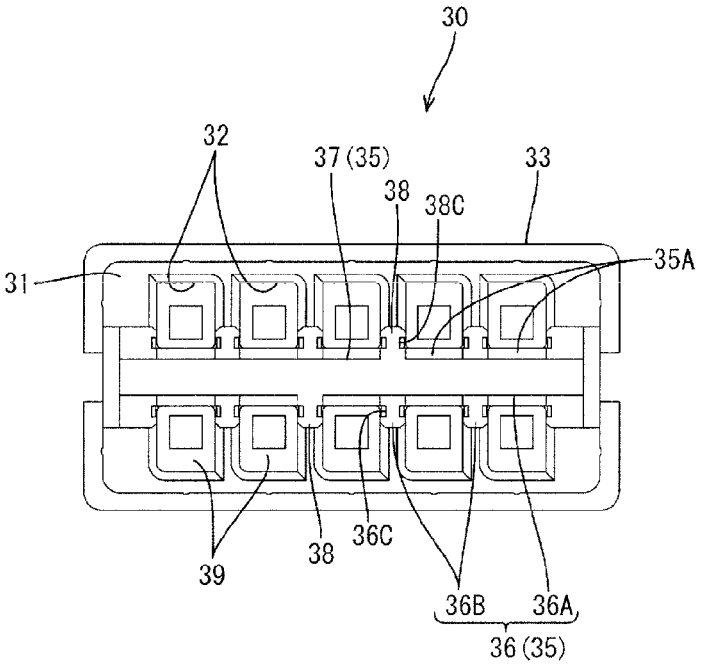
FIG. 9 is a back view of the connector housing.

As shown in FIG. 6, the housing extending plate 35 has a somewhat smaller width than a lateral width of the housing body 31 and extends rearward from a vertically central part (between the cavities 32 in the upper and lower stages) on the rear end of the housing body 31. The housing extending plate 35 includes groove-like terminal placing portions 36 laterally arranged such that the wire connecting portions 23 of the respective terminals 20 are placed thereon and a wire placing portion 37 extending rearwardly of the terminal placing portions 36. A plate thickness of the housing extendingplate 35 is set to be smaller than that of a bottom wall between the rows of the respective cavities 32 in the upper and lower stages, and the housing extending plate 35 is connected unitarily to the housing body 31 via inclined portions 35 inclined rearward from the bottom surfaces of the cavities 32.

The terminal placing portions 36 each have a bottom 36A and groove walls 36B standing from both side edges of the bottoms 36A, and are formed laterally side by side according to the number of the terminals 20 (five in this embodiment) on each of the upper and lower surfaces of the housing extending plate 35. The groove walls 36B located on both lateral ends are connected unitarily to both left and right side walls of the housing body 31 and are thicker than the other groove walls 36B to function also as reinforcing walls of the housing extending portion 35. Further, groove-like recesses 36C are formed on side surfaces of the respective groove walls 36B and extend along an extending direction of the groove walls 36B.

The wire placing portion 37 is flat and flush with the bottom portions 36A of the terminal placing portions 36. A standing wall 38 is provided on each of the upper and lower surfaces of the wire placing portion 37 and extends continuously from one of the groove walls 36B described above. These standing walls 38 are provided continuously with the second groove wall 36B from the right on the upper surface and the second groove wall 36B from the left on the lower surface and extend up to the rear end of the wire placing portion 37. Specifically, these standing walls 38 are arranged at different positions on the upper and lower surfaces of the wire placing portion 37 (see FIG. 9). Further, groove-like recesses 38C continuous with the recesses 36C of the groove walls 36B also extend along the side surfaces of these standing walls 38.

(Shield Shell 40)

Figure 11:
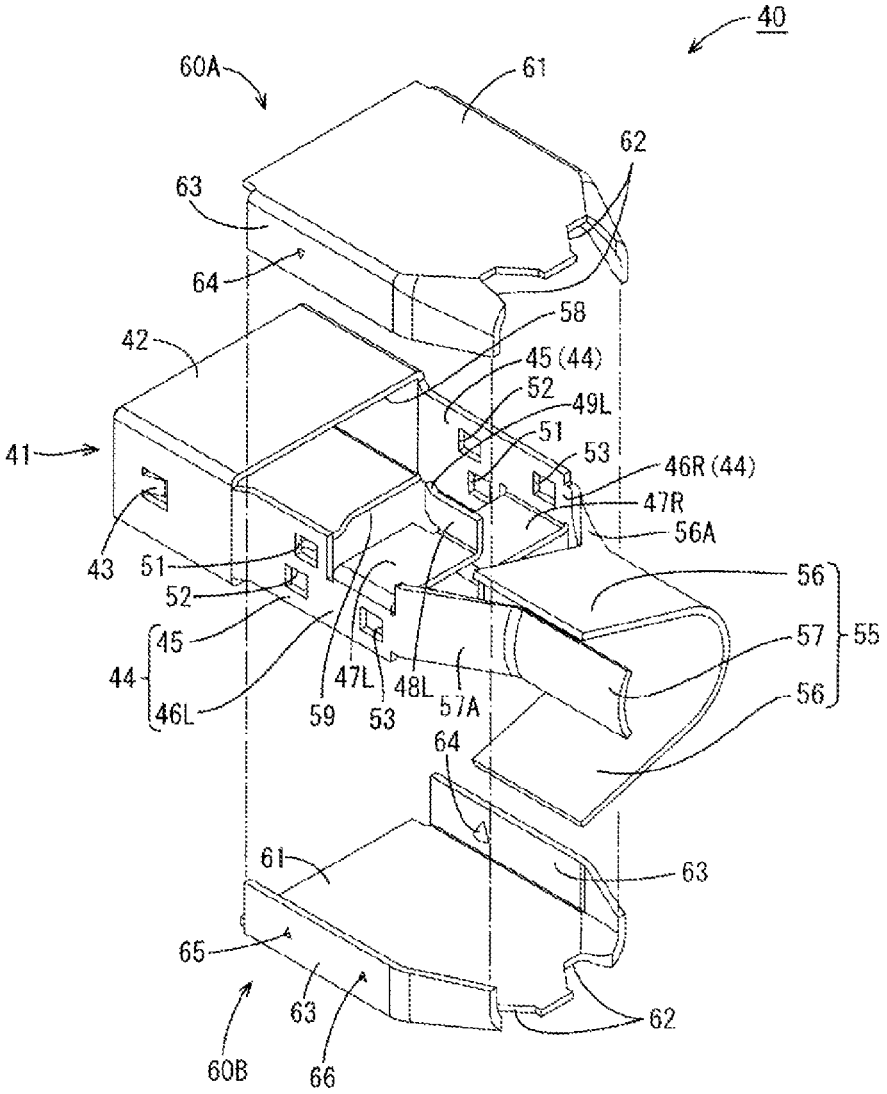
FIG. 11 is an exploded perspective view of a shield shell.
Figure 12:
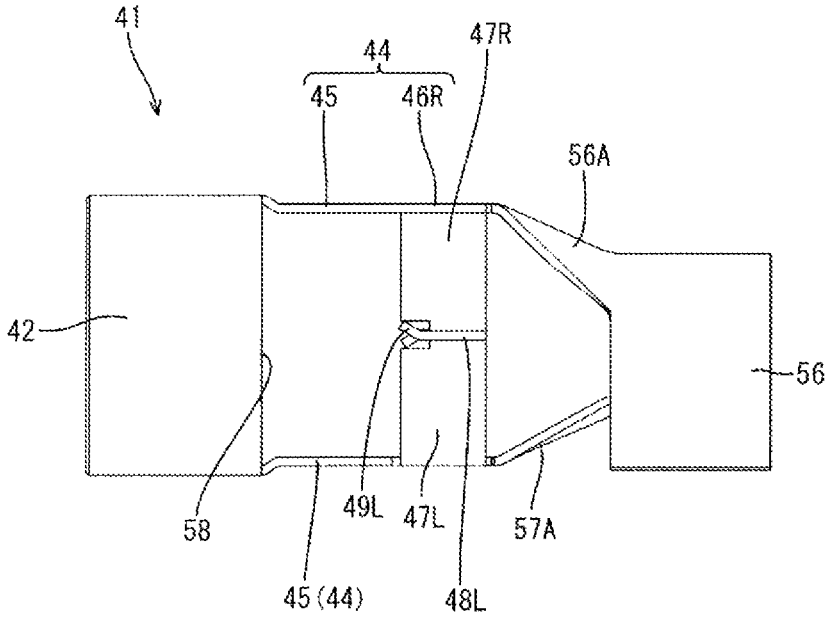
FIG. 12 is a plan view of a shell body.
Figure 13:
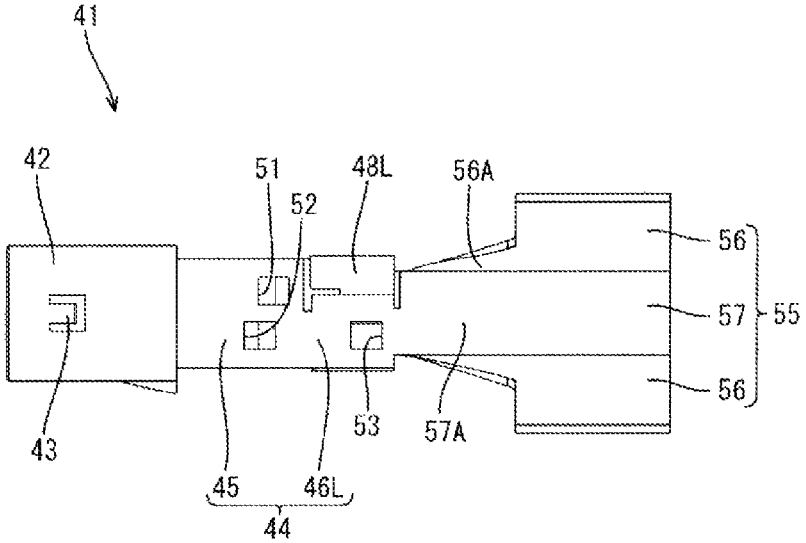
FIG. 13 is a side view of the shell body.
Figure 14:
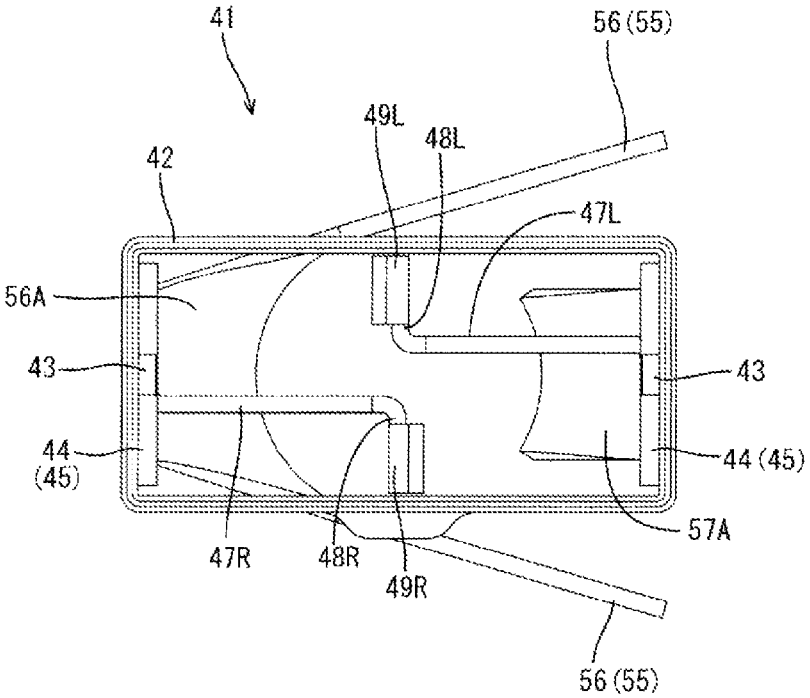
FIG. 14 is a front view of the shell body.

The shield shell 40 is formed by applying punching and bending to a metal plate material such as aluminum, aluminum alloy, copper or copper alloy and includes, as shown in FIG. 11, a shell body 41, a first cover 60A and a second cover 60B.

(Shell Body 41)

The shell body 41 includes a housing enclosing portion 42 for enclosing the housing body 31, two shield extending portions 44 extending rearward from left and right side walls of the housing enclosing portion 42, and a fastening portion 55 extending farther rearward from the rear ends of the shield extending portions 44.

The housing enclosing portion 42 is formed into a rectangular tube of a size to cover the upper surface, left and right side surfaces and the bottom surface of the housing body 31. The housing enclosing portion 42 has a length (dimension in the front-rear direction) so that the front end edge thereof is in contact with the back surface of the flange 33 of the housing body 31 and the rear end edge thereof is flush with the back surface of the housing body 31 with the shell body 41 (housing enclosing portion 42) attached to the housing 30 (housing body 31). Parts of the left and right side walls of the housing enclosing portion 42 are cut and bent inward, thereby forming the locking pieces 43 to be locked to the locking portions 34 of the housing body 31. When the housing 30 is inserted and fit from the front of the housing enclosing portion 42, the locking pieces 43 are locked to the locking portions 34 formed by cutting side surfaces of the housing body 31 to have step-like front sides (see FIG. 23).

The shield extending portions 44 extend rearward along side edges of the housing extendingplate 35 from the left and right side walls of the housing enclosing portion 42 with the shell body 41 attached to the housing 30.

An area of a base side (on the side of the housing enclosing portion 42) of the shield extending portion 44 extending along the side edge of the terminal placing portion 36 defines a first extending portion 45. A vertical dimension of this first extending portion 45 is somewhat shorter than that of the side wall of the housing enclosing portion 42 (see FIG. 13).

Further, an area behind the first extending portion 45 and extending along the side edge of the wire placing portion 37 defines a second extending portion 46. The left second extending portion 46L on a left side (left-front side of FIG. 11) extends from about a lower half area of the first extending portion 45 in a height direction. On the other hand, the right second extending portion 46R on a right side extends from about an upper half area of the first extending portion 45 in the height direction. Specifically, the left and right second extending portions 46L, 46R are provided at different height positions.

A left partition wall 47L is formed on the upper end edge of the left second extending portion 46L and extends toward the right second extending portion 46R. The left partition wall 47L extends substantially to a center of the housing enclosing portion 42 in a width direction (lateral direction). A left standing wall 48L is provided to stand up in about a ⅔ area on a rear side of the tip edge of the left partition wall 47L in an extending direction. A left inclined wall 49L is provided on the front end edge of this left standing wall 48L and extends obliquely toward a right-front side. The tip of the left inclined wall 49L extends to the vicinity of the standing wall 38 on the upper surface side of the housing extending portion 35 with the shell body 41 attached to the housing 30 (see FIGS. 19 and 22).

On the other hand, a right partition wall 47R is formed on the lower end edge of the right second extending portion 46R and extends toward the left second extending portion 46L. The right partition wall 47R extends substantially to the center of the housing enclosing portion 42 in the width direction (lateral direction). A right standing wall 48R stands down in about a ⅔ area on a rear side of the tip edge of the right partition wall 47R in an extending direction (see FIGS. 14 and 15). A right inclined wall 49R is provided on the front end edge of this right standing wall 48R and extends obliquely toward a left-front side. The tip of the right inclined wall 49R extends to the vicinity of the standing wall 38 on the lower surface side of the housing extending plate 35 with the shell body 41 attached to the housing 30 (see FIG. 22).

Figure 22:
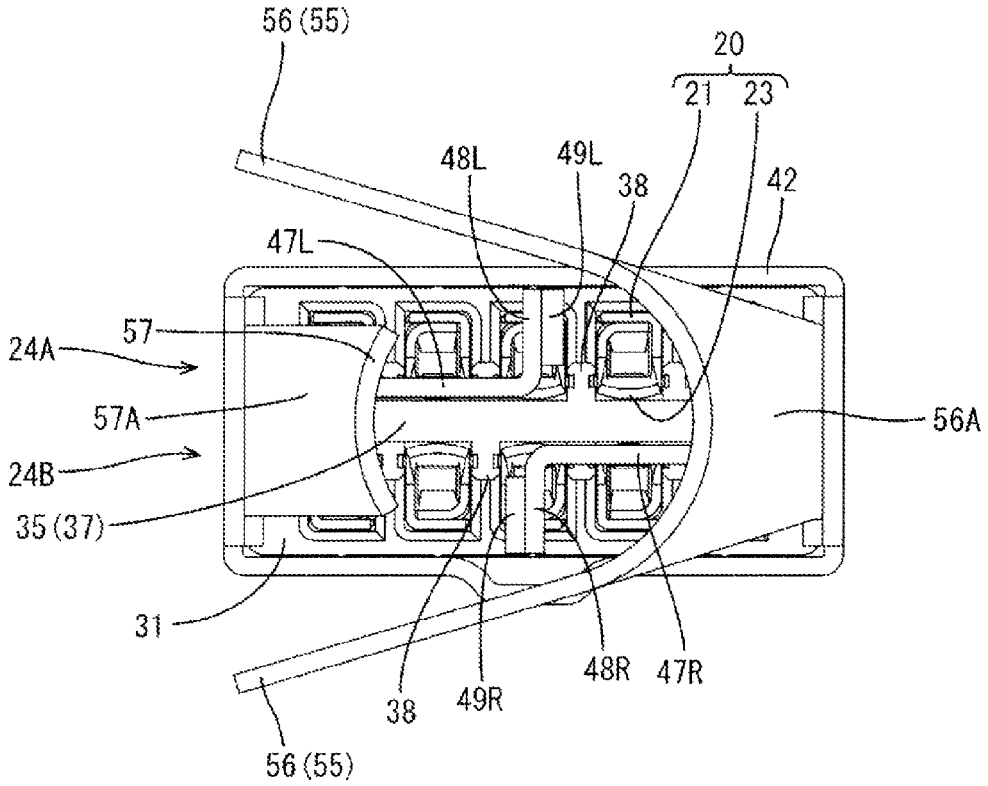
FIG. 22 is a back view showing the state where the shell body is attached to the housing.
Figure 23:
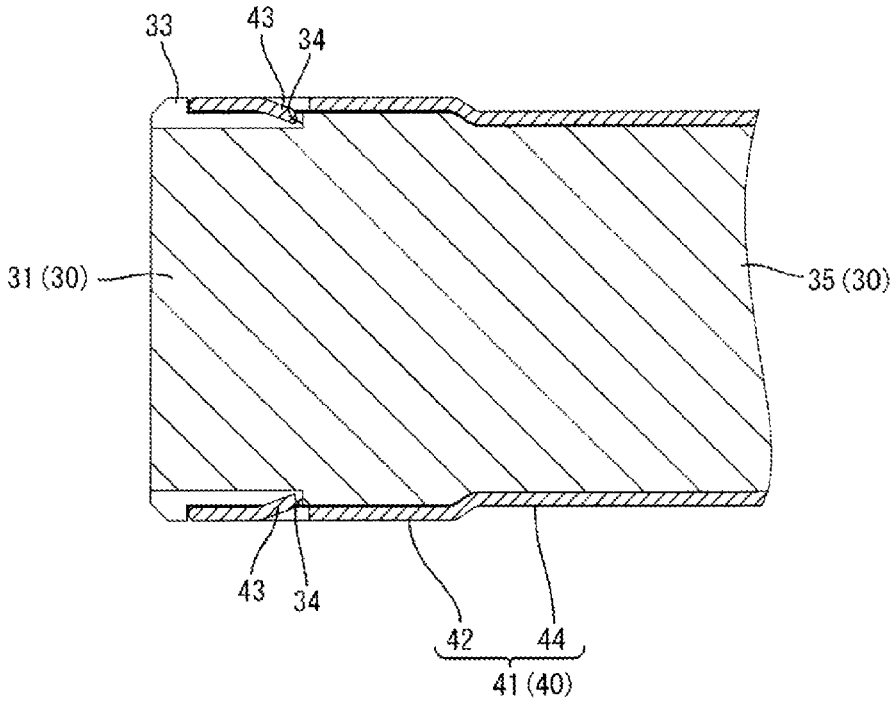
FIG. 23 is a section along A-A of FIG. 20.

Note that a shortest distance between a plane including the lower surface of the left partition wall 47L and a plane including the upper surface of the right partition wall 47R is equal to or slightly longer than a thickness of the housing extending portion 35 (see FIG. 22).

Further, each of the first extending portions 45 is provided with two rectangular locking holes 51, 52 at positions slightly displaced in the vertical direction. Further, each of the second extending portions 46L, 46R also is provided with one rectangular locking hole 53.

The fastening portion 55 extends behind the two shield extending portions 44. In this embodiment, the fastening portion 55 includes two barrel pieces 56 and a pressing piece 57. Vertical and lateral positions of the barrel pieces 56 and the pressing piece 57 are set such that an axial center of the shielded cable 11 is arranged at a position overlapping an axial center of the shell body 41 (housing enclosing portion 42) when the shielded cable 11 is fastened by the barrel pieces 56.

More specifically, the barrel pieces 56 are provided integrally to the right shield extending portion 44 via a barrel piece side coupling portion 56A connected to the rear end edge of the right second extending portion 46R. The barrel piece side coupling portion 56A has a substantially trapezoidal shape whose width is widened gradually from a base end side toward a rear side (see FIG. 13). The barrel piece side coupling portion 56A is set such that a width of a base end part thereof is about equal to a dimension of the rear end edge of the right second extending portion 46R, and is arranged below the right second extending portion 46R while forming a step in the height direction. Thus, the barrel pieces 56 are arranged symmetrically with respect to a center line in the height direction of the shell body 41.

Further, the two barrel pieces 56 are set such that their lateral positions are at the aforementioned predetermined position (position where the shielded cable 11 is fastened such that the axial center of the shielded cable 11 and that of the shell body 41 overlap) since the barrel piece side coupling portion 56A extends obliquely toward a left-rear side from the rear end edge of the right second extending portion 46R.

Figure 15:
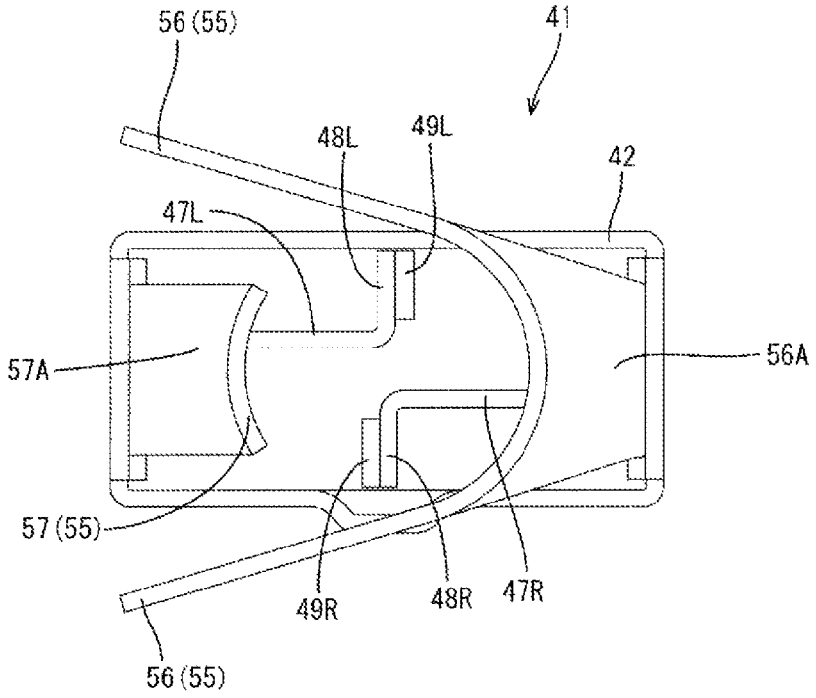
FIG. 15 is a back view of the shell body.

Note that, in a state before fastening, the barrel pieces 56 form a substantially V shape open leftward, as shown in FIGS. 11 and 15.

On the other hand, the pressing piece 57 is integral to the left shield extending portion 44 via a pressing piece side coupling portion 57A connected to the rear end edge of the left second extending portion 46L. The pressing piece side coupling portion 57A and the pressing piece 57 are set such that widths (dimensions in the vertical direction) thereof are about equal to a dimension of the ear end edge of the left second extending portion 46L, and is arranged above the left second extending portion 46L while forming a step in the height direction. Thus, the pressing piece side coupling portion 57A and the pressing piece 57 are arranged in a central part in the height direction of the shell body 41 (see FIG. 13). Specifically, the pressing piece 57 is arranged at a position facing the two barrel pieces 56.

The pressing piece 57 is curved in a width direction thereof so as to extend along an extending direction of the shielded cable 11 and to be fastened together with the shield layer 16 exposed at the end part of the shielded cable 11 by the barrel pieces 56 when the shielded cable 11 is fastened by the barrel pieces 56 (see FIG. 15).

The pressing piece 57 is set such that the lateral position thereof is at the aforementioned predetermined position (position along the shielded cable 11 arranged such that the axial center overlaps that of the shell body 41) since the pressing piece side coupling portion 57A extends obliquely toward a right-rear side from the rear end edge of the left second extending portion 46L The shielded cable 11 can be held stably held in the shell body 41 by being arranged between the barrel pieces 56 and being fastened together with the pressing piece 57 by the barrel pieces 56.

Note that the barrel pieces 56 and pressing piece 57 also function as a shield connecting portion to be connected to the shield layer 16 folded outwardly of the insulation coating 17 at the end part of the shielded cable 11.

Figure 18:
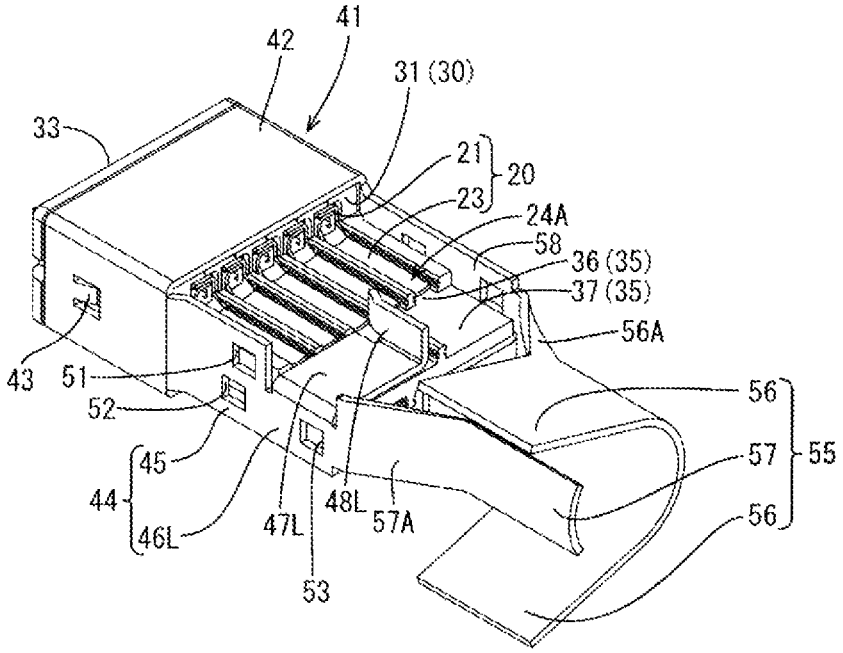
FIG. 18 is a perspective view showing a state where the shell body is attached to the housing.
Figure 19:
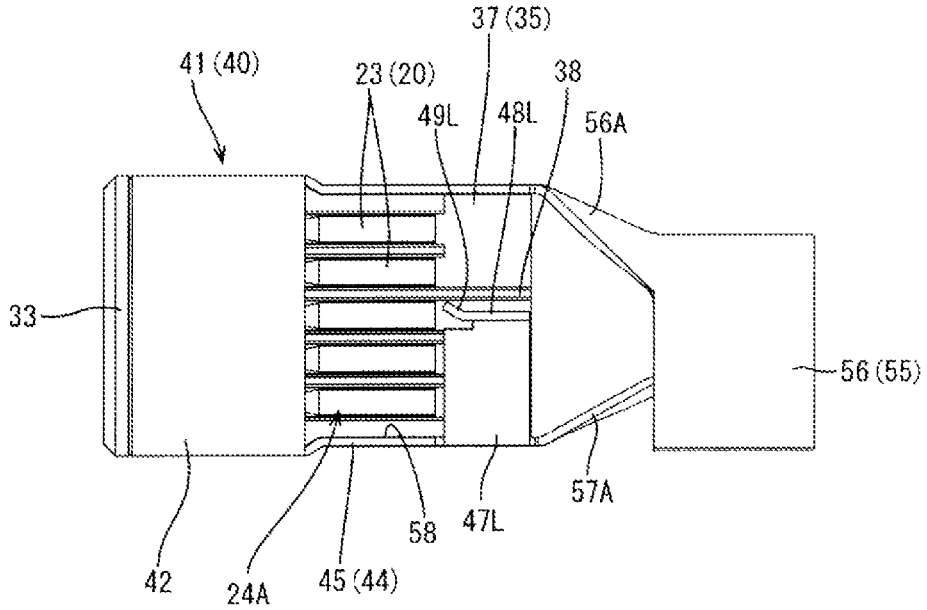
FIG. 19 is a plan view showing the state where the shell body is attached to the housing.
Figure 20:
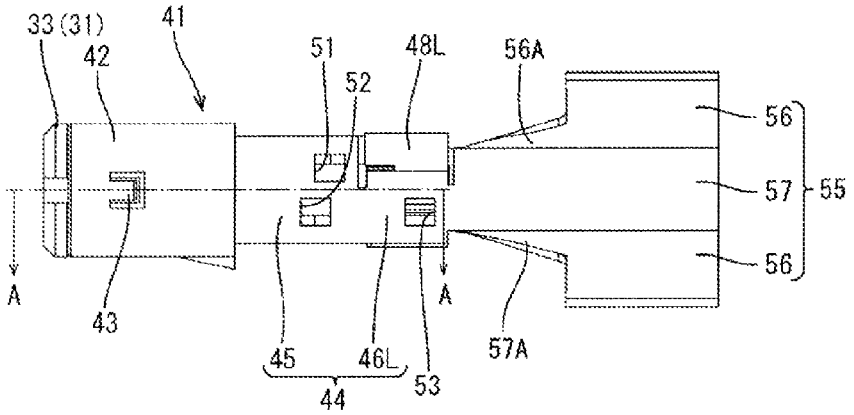
FIG. 20 is a side view showing the state where the shell body is attached to the housing.
Figure 21:
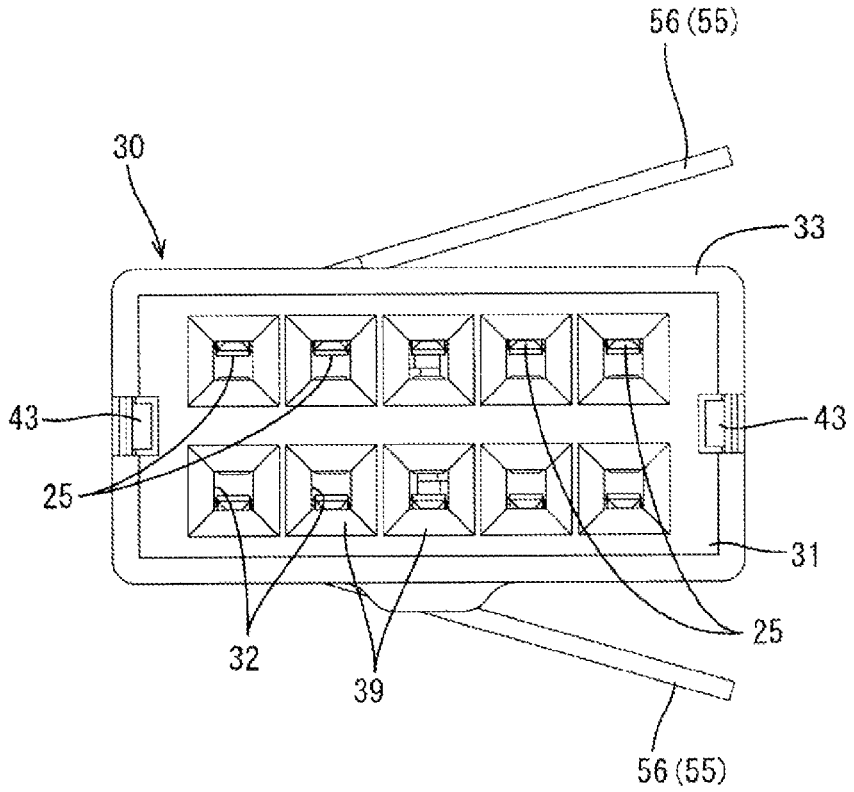
FIG. 21 is a front view showing the state where the shell body is attached to the housing.

As shown in FIG. 18, with the shell body 41 attached to the housing 30 accommodating the terminals 20, the housing body 31 is enclosed by the housing enclosing portion 42 and the terminal placing portions 36 of the housing extending plate 35 and the wire connecting portions 23 of the terminals 20 arranged on the terminal placing portions 36 are exposed upward and downward. Further, the wire placing portion 37 is sandwiched between the left and right partition walls 47L, 47R (see FIG. 22) and partially exposed upward and downward. In other words, a side of the shell body 41 behind the housing enclosing portion 42 is open upward and downward. An upward open part and a downward open part of this shell body 41 are called a first opening 58 and a second opening 59.

These first and second openings 58, 59 are covered by the first and second covers 60A, 60B (see FIG. 11). In this embodiment, the first and second covers 60A, 60B have the same shape and size. In the case of not distinguishing the first and second covers 60A, 60B, these covers are referred to as the covers 60 below.

(Covers 60)

Figure 16:
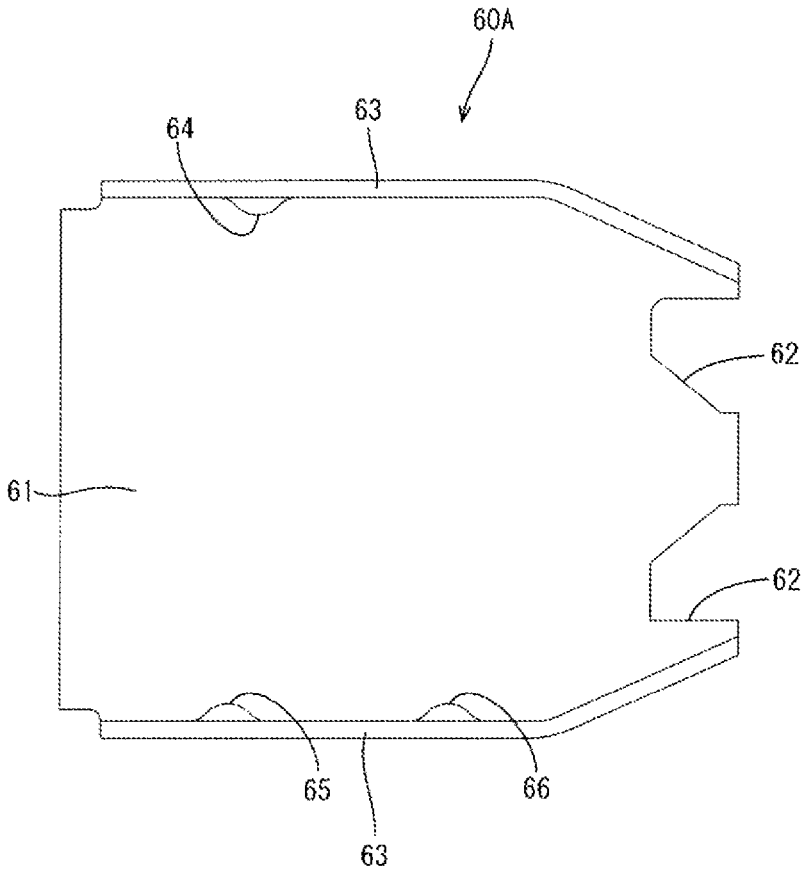
FIG. 16 is a bottom view of a first cover.

As shown in FIGS. 11 and 16, the cover 60 includes a plate-like bottom wall 61 substantially hexagonal in a plan view. The bottom wall 61 is sized to cover the first or second opening 58, 59 of the shell body 41 from above or below. A side edge of the bottom wall 61 on a rear side with the cover 60 attached to the shell body 41 is cut forward at positions near both end parts, thereby providing cut portions 62.

Figure 17:
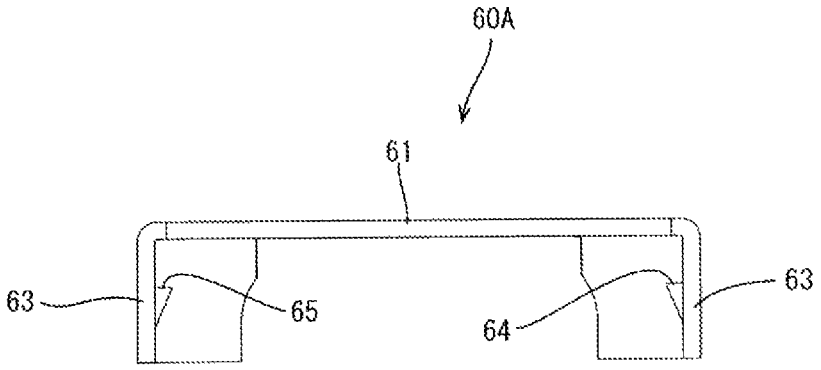
FIG. 17 is a front view of the first cover.

Side walls 63 extending down in FIG. 17 are provided to stand on side edge parts of the bottom wall 61 overlapping the shield extending portions 44 and side edge parts of the bottom wall 61 overlapping the barrel piece side coupling portion 56A and the pressing piece side coupling portion 57A. These side walls 63 are struck inward at positions corresponding to three locking holes 51, 52 and 53 of the shield extending portions 44 described above, thereby forming locking protrusions 64, 65 and 66 to be locked to the locking holes 51, 52 and 53.

Next, how to assemble the shield connector 10 of this embodiment is described. In assembling the shield connector 10, the terminal connecting portions 21 of the terminals 20 are inserted into the cavities 32 of the housing body 31 from behind. When the terminal connecting portion 21 comes into contact with the front stop wall 39 in the cavity 32 and is arranged at a proper position by being retained by the withdrawal restricting piece (not shown), the wire connecting portion 23 is arranged on the terminal placing portion 36 of the housing extending plate 35 (see FIG. 10).

Subsequently, the housing enclosing portion 42 of the shell body 41 is brought closer to the housing 30 holding the terminals 20 from behind and externally fit to the housing body 31. At this time, the locking pieces 43 of the housing enclosing portion 42 are deformed resiliently to open by being pressing by the left and right side surfaces of the housing 30. The locking pieces 43 resiliently return to be locked to the locking portions 34 when reaching the locking portions 34. In this way, the housing enclosing portion 42 and the housing body 31 are locked at a proper position. In this state, the front end edge of the housing enclosing portion 42 is in contact with the back surface of the flange 33 of the housing body 31 (see FIGS. 18 and 23).

Further, the wire placing portion 37 of the housing extending plate 35 at this time is sandwiched between the left and right partition walls 47L, 47R of the shell body 41 (see FIG. 22).

In this state, the housing body 31 is enclosed by the housing enclosing portion 42 and the wire connecting portions 23 and the terminal placing portions 36 are exposed upward and downward through the first and second open portions 58, 59. Further, the wire placing portion 37 is sandwiched between the left and right partition walls 47L, 47R and partially exposed upward and downward through the first and second openings 58, 59. Further, the tips of the inclined walls 49L, 49R extend to the vicinities of the standing walls 38 (see FIG. 19).

Figure 24:
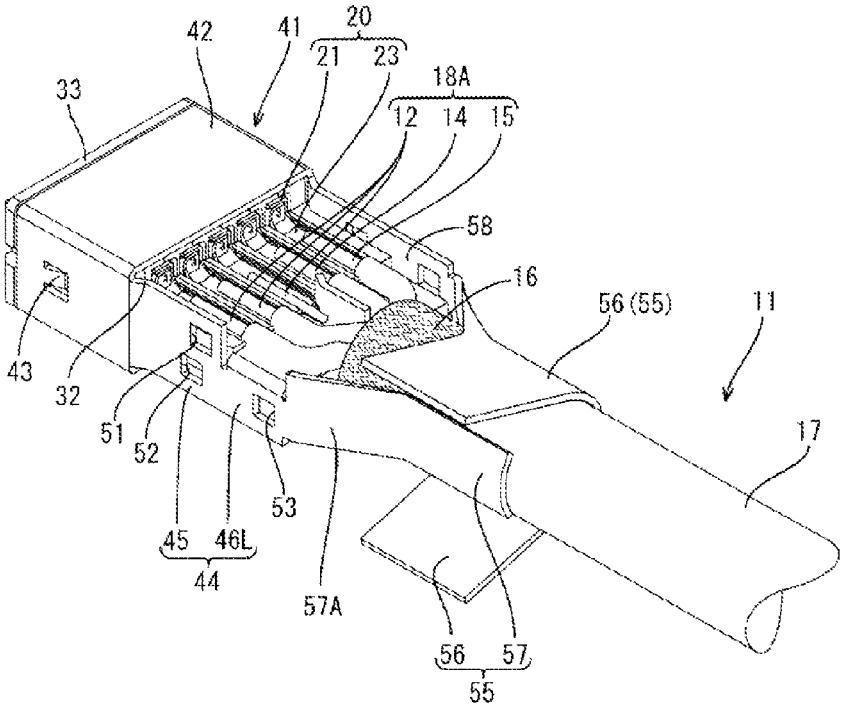
FIG. 24 is a perspective view showing a state where wires are arranged on wire connecting portions.

Subsequently, the leading end side of the shielded cable 11 is brought closer from the side of the fastening portion 55 and inserted between the two barrel pieces 56 and the pressing piece 57 and, out of the ten wires 12, 13, 14 and 15 exposed by removing the insulation coating 17, five wires (wires 12, 14 and 15) included in the first wire row 18A are respectively placed on the upper surfaces of the wire connecting portions 23 in the upper stage (see FIG. 24). At this time, the insulation coatings of the wires 12, 14 and 15 are placed on the exposed wire placing portion 37 or the left partition wall 47L. Further, a part of the shield layer 16 of the shielded cable 11 is arranged between the barrel pieces 56. Then, each wire 12, 14, 15 and the wire connecting portion 23 are connected by soldering.

At this time, since the housing extending plate 35 is arranged between the first and second wire rows 18A, 18B, the contact of the wires 12, 13 included in the second wire row 18B with solder can be prevented when soldering the wires 12, 14, 15 included in the first wire row 18A. Further, since the terminal placing portions 36 are provided with the groove walls 36B and the adjacent wires 12, 14 and 15 are partitioned by the groove walls 36B, a short circuit of the respective USB 3.0 wires 12, the ground wire 15 and the power supply wire 14 is also suppressed.

After solder connection of the first wire row 18A and the terminals 20 is finished, the entire assembly is subsequently turned upside down and five wires 12, 13 of the second wire row 18B are placed on the upper surfaces of the wire connecting portions 23 of predetermined terminals 20. Then, similarly, the wires 12, 13 and the wire connecting portions 23 are connected by soldering.

Figure 25:
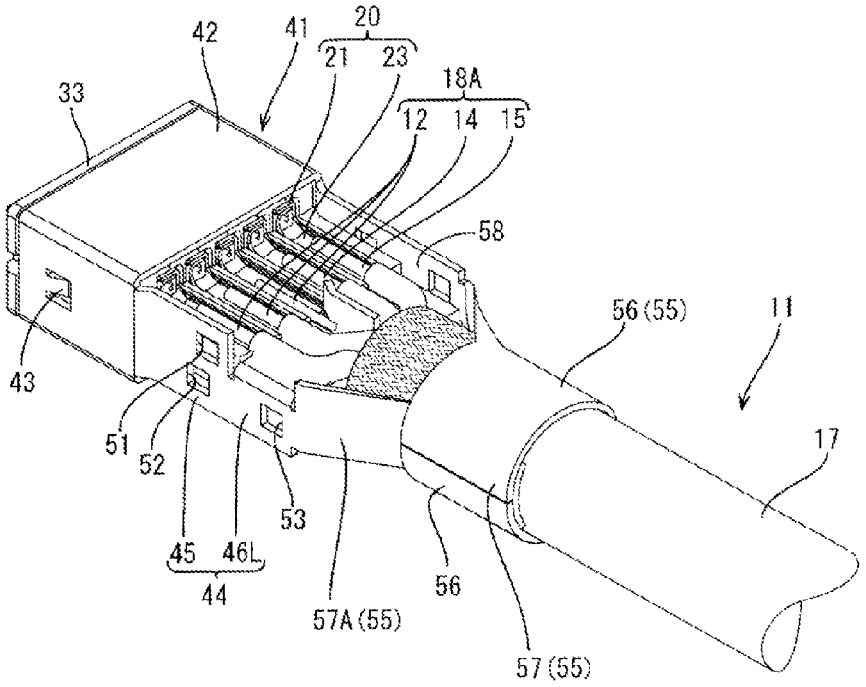
FIG. 25 is a perspective view showing a state where a fastening portion is fastened.
Figure 26:
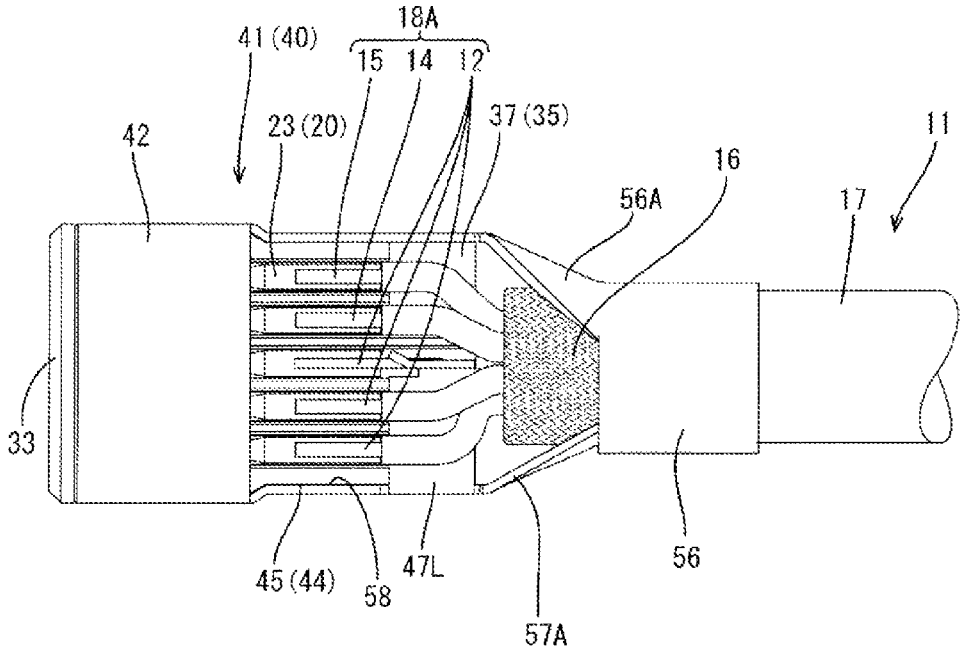
FIG. 26 is a plan view showing the state where the fastening portion is fastened.
Figure 27:
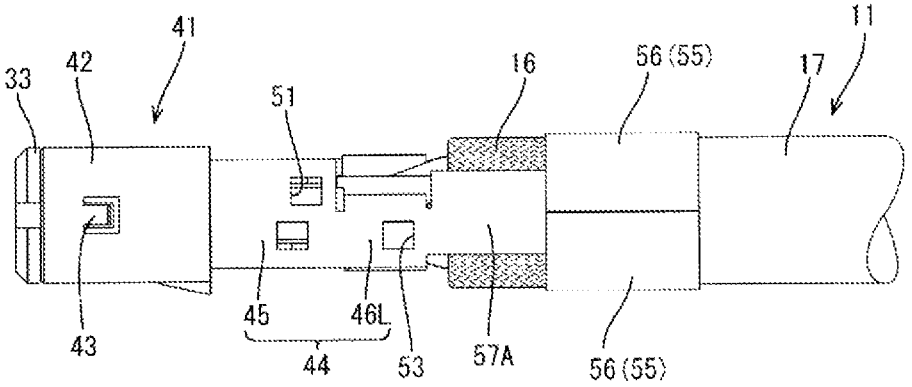
FIG. 27 is a side view showing the state where the fastening portion is fastened.

After solder connection of the terminals 20 and the wires 12 to 15 is finished, the shielded cable 11 and the pressing piece 57 are fastened collectively by the two barrel pieces 56 (see FIGS. 25 to 27). At this time, the axial center of the shielded cable 11 is arranged to overlap that of the shell body 41 (housing enclosing portion 42). Further, the barrel pieces 56 and the pressing piece 57 are also in contact with the shield layer 16 of the shielded cable 11 and electrically connected to each other.

Finally, the first and second openings 58, 59 of the shell body 41 are covered respectively covered with the first and second covers 60A, 60B. Specifically, the locking protrusions 64, 65 and 66 of each cover 60 are locked respectively to the locking holes 51, 52 and 53 of the shell body 41. In this way, the shield connector 10 is completed (see FIGS. 1 and 2).

According to this embodiment, the shield shell 40 for accommodating the housing 30 is composed of the shell body 41 including the first and second openings 58, 59, the first cover 60A for covering the first opening 58 and the second cover 60B for covering the second opening 59, and the housing extending plate 35 is exposed through the first and second openings 58, 59. Thus, a soldering operation of the terminals 20 and the wires 12 to 15 can be performed easily through the first and second openings 58, 59. Therefore, before the terminals 20 and the wires 12 to 15 are connected, it is possible to accommodate the terminals 20 into the housing 30 and the shield shell 40 (shell body 41) into the housing 30 in advance.

In addition, since a first terminal row 24A and a second terminal row 24B are partitioned completely by the housing extending plate 35, the terminals 20 (wire connecting portions 23) of the first terminal row 24A and the terminals 20 (wire connecting portions 23) of the second terminal row 24B are not short-circuited by soldering even if the soldering operation is performed with the terminals 20 accommodated in the housing 30.

Further, since the first and second covers 60A, 60B have the same shape and size, manufacturing cost can be suppressed.

Further, in this embodiment, the shield shell 40 is provided with the first and second openings 58, 59 as described above. Thus, the barrel piece side coupling portion 56A that couples the shell body 41 to the barrel pieces 56 is provided on the rear end of the narrow right second extending portion 46R. However, the pressing piece 57 is provided at the position facing the barrel pieces 56, and the shielded cable 11 and the pressing piece 57 are fastened collectively by the barrel pieces 56. Thus, the shield shell 40 (shell body 41) and the end part of the shield layer 16 can be connected reliably and the shielded cable 11 can be held reliably in the shield shell 40.

As just described, according to this embodiment, the shield connector 10 is obtained which has a simple configuration and is assembled easily.

The technique disclosed in this specification is not limited to the above described embodiment. For example, the following embodiments also are included in the scope of the invention.

In the above embodiment, the terminals 20 and the wires 12 to 15 are soldered after the terminals 20 are accommodated into the housing 30 and the housing 30 is accommodated into the shell body 41 in advance. However, a work procedure is not limited to that of the above embodiment and can be appropriately changed.

The leading end of the shielded cable 11 is inserted into between the two barrel pieces 56 and the pressing piece 57 and placed on the wire connecting portions 23 of the terminals 20 (housing extending portion 35 of the housing 30) in the above embodiment. However, the pressing piece 57 may be arranged at a position distant from the barrel pieces 56 until the shielded cable 11 is arranged at the predetermined position and arranged in a direction along the extending direction of the shielded cable 11 after the shielded cable 11 is arranged at the predetermined position.

Although the barrel pieces 56 are fastened after the wires 12 to 15 and the wire connecting portions 23 of the terminals 20 are soldered in the above embodiment, fastening may be performed prior to soldering.

Further, attachment timings of the covers 60 after the soldering operation are also not limited to those of the above embodiment and the first cover 60A may be attached before the terminals 20 and the wires 12, 13 exposed through the second opening 59 are soldered.

Although the first and second covers 60A, 60B have the same shape and size in the above embodiment, they may have different shapes and/or sizes.

The pressing piece 57 may be omitted.

The type of the shielded cable 11 is not limited to that of the above embodiment and an arbitrary shielded cable can be used.

LIST OF REFERENCE SIGNS

10: shield connector
11: shielded cable
12, 13, 14, 15: wire
16: shield layer
17: insulation coating
20: terminal
21: terminal connecting portion
23: wire connecting portion
24A: first terminal row
24B: second terminal row

30: housing
31: housing body
35: housing extending portion
40: shield shell
41: shell body
55: fastening portion
56: barrel piece
57: pressing piece
58: first open portion
59: second open portion
60A: first cover
60B: second cover

The invention claimed is:

1. A shield connector, comprising:

a plurality of wires;

a plurality of terminals, each of the terminals having a terminal connecting portion to be connected to a mating terminal and a wire connecting portion to be soldered respectively to one of the plurality of wires;

a housing having a housing body configured for arranging and holding the terminal connecting portions in a first terminal row and a second terminal row arranged in two stages in a vertical direction, the first and second terminal rows being formed by laterally arranging the terminals in the respective terminal row, the housing further including a housing extending plate extending rearward from the housing body along a connecting direction to a mating housing and arranged between the wire connecting portions of the first terminal row and the wire connecting portions of the second terminal row, the housing extending plate including a first surface with first groove walls arranged between the wire connecting portions of adjacent ones of the terminals in the first terminal row, and a second surface with second groove walls arranged between the wire connecting portions of the terminals in the second terminal row; and a shield shell including a tubular housing enclosing portion covering the housing body, the shield shell further including opposite first and second extending portions extending rearward from the housing enclosing portion at opposite first and second sides of the housing extending plate, first and second partition walls extending respectively from the first and second extending portions and disposed respectively on the first and second surfaces of the extending plate, and first and second standing walls extending away from the extending plate from ends of the respective first and second partition plates remote from the extending portions, a first opening and a second opening for exposing each of the extending portions of the shield and the opposite first and second surfaces of the housing extending plate, a first cover mounted to at least one of the first and second extending portions for covering the first opening and a second cover to at least one of the first and second extending portions or to the first cover for covering the second opening portion.

2. The shield connector of claim 1, wherein the first partition wall is rearward of and substantially adjacent a plurality of the first groove walls, and the second partition wall is rearward of and substantially adjacent a plurality of the second groove walls.

3. The shield connector of claim 1, wherein the first and second covers have the same shape and size.

4. The shield connector of claim 3, wherein:

the wires are enclosed collectively by a shield layer and an insulation coating covering an outer periphery of the shield layer;

an end part of the shield layer is exposed at an end part of the insulation coating; and the shield shell includes two barrel pieces for fastening the end part of the shield layer and a pressing piece extending along the end part of the shield layer and to be fastened together with the end part of the shield layer by the barrel pieces.

5. The shield connector of claim 1 wherein the first cover contacts and end of the first standing wall remote from the first partition wall, and the second cover contacts an end of the second standing wall remote from the second partition wall.

6. The shield connector of claim 5, wherein the first partition wall is rearward of and substantially adjacent a plurality of the first groove walls, and the second partition wall is rearward of and substantially adjacent a plurality of the second groove walls.

7. A shield connector, comprising:

wires enclosed collectively by a shield layer and an insulation coating covering an outer periphery of the shield layer, an end part of the shield layer is exposed at an end part of the insulation coating;

terminals provided respectively with terminal connecting portions to be connected to mating terminals and wire connecting portions to be soldered respectively to one of the wires;

a housing having a housing body configured for arranging and holding the terminal connecting portions in a first terminal row and a second terminal row arranged in two stages in a vertical direction, the first and second terminal rows being formed by laterally arranging the terminals in the respective terminal row, the housing further including a housing extending plate extending rearward from the housing body along a connecting direction to a mating housing and arranged between the wire connecting portions of the first terminal row and the wire connecting portions of the second terminal row, the housing extending plate including groove walls arranged between the wire connecting portions of adjacent ones of the terminals; and a shield shell covering the housing, the shield shell including a first opening and a second opening for exposing each of opposed surfaces of the housing extending plate, a first cover for, the shield shell includes two barrel pieces for fastening the end part of the shield layer and a pressing piece extending along the end part of the shield layer and to be fastened together with the end part of the shield layer by the barrel pieces.

* * * * *